US008684393B2

(12) United States Patent
Puget et al.

(10) Patent No.: US 8,684,393 B2
(45) Date of Patent: Apr. 1, 2014

(54) ALPINE SKI

(75) Inventors: Nicolas Puget, Novalaise (FR); Vincent Bregeon, Flacheres (FR); Johan Vailli, Coublevie (FR)

(73) Assignee: Skis Rossignol (FR)

( * ) Notice: Subject to any disclaimer, the term of this patent is extended or adjusted under 35 U.S.C. 154(b) by 563 days.

(21) Appl. No.: 12/966,724

(22) Filed: Dec. 13, 2010

(65) Prior Publication Data

US 2011/0169248 A1 Jul. 14, 2011

(30) Foreign Application Priority Data

Jan. 8, 2010 (FR) ..... 10 50110

(51) Int. Cl.
*A63C 5/04* (2006.01)

(52) U.S. Cl.
USPC ..... 280/609; 280/608; 280/602

(58) Field of Classification Search
USPC ..... 280/601–610
See application file for complete search history.

(56) References Cited

U.S. PATENT DOCUMENTS

| | | | | |
|---|---|---|---|---|
| 6,986,525 | B2 * | 1/2006 | Liard | 280/609 |
| 2008/0116662 | A1 * | 5/2008 | Bourgier et al. | 280/609 |

FOREIGN PATENT DOCUMENTS

| | | | |
|---|---|---|---|
| EP | 1120137 | A1 | 8/2001 |
| EP | 1410826 | B1 | 11/2007 |
| EP | 1925344 | A1 | 5/2008 |
| EP | 2082787 | A1 | 7/2009 |
| FR | 2786108 | A1 | 5/2000 |
| WO | 2007065280 | A1 | 6/2007 |

OTHER PUBLICATIONS

French Search Report; Application No. FR 1050110; Oct. 1, 2010; 2 pages.

* cited by examiner

*Primary Examiner* — Katy M Ebner
(74) *Attorney, Agent, or Firm* — St. Onge Steward Johnston & Reens LLC

(57) ABSTRACT

A ski which when it is flat on a horizontal plane, and loaded at its waist in such a way that the edges touch said horizontal plane at the waist, has a side cut extending between the front and rear contact lines; when it is pivoted around its longitudinal axis and tilted by a non-zero angle α relative to said horizontal plane, and loaded at its waist in such a way that one of the edges touches said plane at the waist, has a side cut extending between two end contact points, front and rear respectively wherein for a tilt (α) equal to 35°, the ratio of the distance (Dα) separating the front end contact point and the front contact line, related to the distance (D) separating the mid-point (9) of the shoe and the front contact line, is more than 12%.

15 Claims, 3 Drawing Sheets

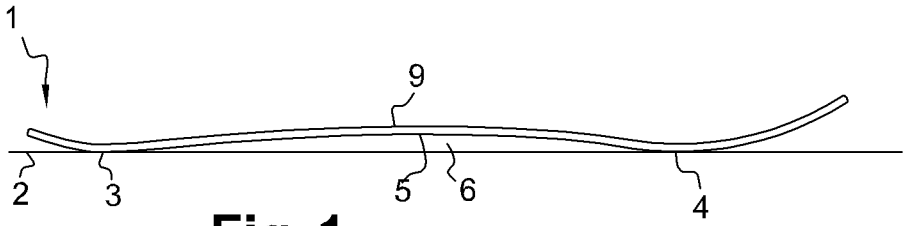
Fig. 1
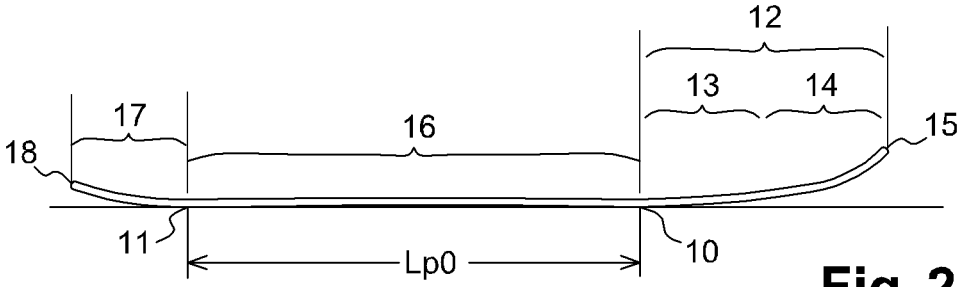
Fig. 2
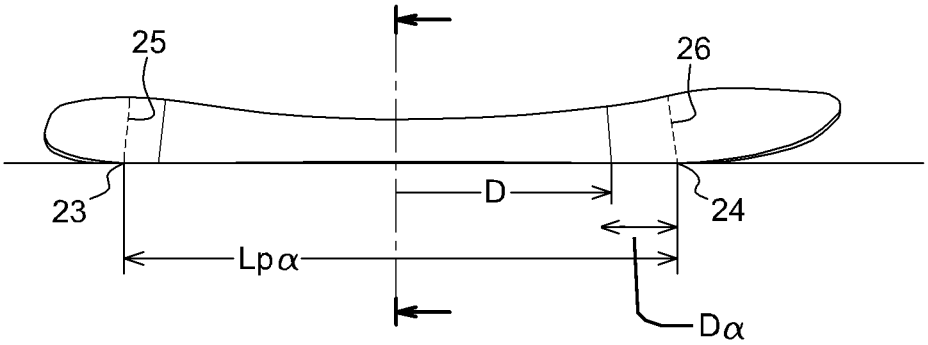
Fig. 3
Fig. 4
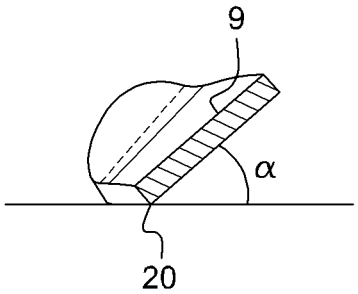

ALPINE SKI

CROSS-REFERENCE TO RELATED APPLICATIONS

The present application claims priority of pending French patent application No. 1050110 filed on Jan. 8, 2010, the content of which is incorporated herein by reference.

FIELD OF THE INVENTION

The invention relates to the field of sports that involve sliding on snow, and more particularly alpine skiing. It is more specifically related to a specific geometry of a ski for improving the behavior thereof in terms of maneuverability and turn control.

BACKGROUND OF THE INVENTION

Generally speaking, alpine skis have a bearing surface which is defined in a standardized way as being the running surface in contact with a horizontal plane when the ski is loaded at its waist, this bearing surface being bounded at the front and at the rear by limit lines known as front and rear "contact lines".

It has been noted that the maneuverability of a ski might be improved by reducing this bearing surface, in order to facilitate the pivoting movements of the board around a vertical axis. This trend therefore comprises bringing the front and/or rear contact lines closer to the waist zone.

The consequence of this is to increase the length of the tip and of the tail, which are the zones defined in a standardized way as being beyond the front and rear contact lines respectively. On this type of ski two main tip areas can thus be defined overall, namely a tip first zone or initial section, directly forward of the front contact line, which has a large radius of curvature, and which is continued by a second part forming the tip upturn, with a lower radius of curvature and which ends with the front end of the ski.

The problem raised by this type of board geometry lies in reducing the contact length, in other words the length of the edge which is in contact with the snow, when the ski is tilted on the edge. Indeed, when the skier performs a turn, and he tilts the ski laterally, causing it to pivot around its longitudinal axis, only the edge on the inner side of the turn remains in contact with the snow. Given the geometry of the board, end contact points can then be identified, located beyond the front and rear contact lines, defining the limits of the contact length as a function of the tilt of the board.

In fact, the maneuverability gain, with the ski flat, consecutive upon moving back the front contact line, is conveyed by a reduction in the contact length, even when the ski is tilted. Usually, the search for a sufficiently large contact length naturally involves an increase in the bearing surface, and therefore a reduction in maneuverability.

The objective of the invention is therefore to provide a ski which is able to offer a combination of good maneuverability properties with the ski flat and optimum turn control through sufficient contact length when the ski is tilted.

SUMMARY OF THE INVENTION

The invention therefore relates to a ski on which different points can be defined on its length. Thus, when the ski is flat on a horizontal plane, and it is loaded at its center in such a way that the edges touch the horizontal plane at the waist, the ski has a contact surface, and a contact length at the edges, which extend between the front and rear contact lines. Conversely, when the ski is pivoted around its longitudinal axis, and it is therefore tilted by a non-zero angle relative to the same horizontal plane, while being loaded at its waist in such a way that one of the edges touches the horizontal plane at the waist, the ski then has a contact length that extends from the end contact points hereinafter referred to as "front end contact points" and "rear end contact points". It is pointed out that when the ski is tilted, a force is exerted perpendicularly to its upper face and at the waist, in order to counter the natural camber of the board, so that as a function of the radius of curvature of the side cut, the ski is deformed until the edge comes into full contact with the horizontal plane at the waist.

In accordance with a first inventive feature, for a tilt of 35°, the ratio of the distance separating the front contact line and the front end contact point, related to the distance separating the mid point of the shoe from the front contact line, is more than 12%. For a tilt of 45°, the same ratio is more than 15%, and preferentially between 18% and 21%.

Put another way, the geometry of the inventive ski is such that the contact length when turning, i.e. when the ski is tilted, is much more than the contact length when the ski is flat. In other words, the contact length on a tilted ski, which is particularly useful in terms of turn control, is relatively large, compared with the contact length when the ski is flat, i.e. in a situation where it is therefore advantageous for it to be smaller to facilitate ski maneuverability. To obtain this result, it is possible in particular to select an adapted side cut, together with adapted camber, tip height and tail height profiles, for each ski size.

In practice, the contact length lengthening measurement made by comparing the flat ski with the ski at a tilt of 35° is more than 70 millimeters, and even more than 90 millimeters for a tilt of 45°.

According to another inventive feature, it is possible to define on the ski a "forward contact line", which corresponds to the front limit of the contact zone of the ski on a horizontal plane when the ski is on the one hand, applied on this horizontal plane at its waist, and when additionally it receives a vertical force corresponding to a mass of 2 kg at its front end. In other words, the ski is loaded at its waist in such a way that its camber is canceled and complementarily, the ski is also loaded at its front end, but with a force corresponding to a mass of 2 kg, in such a way that the contact surface is lengthened as far as the characteristic forward contact line. Beyond this forward contact line is found the part of the tip that is useful so that the ski does not get stuck in the snow. This tip zone has a radius of curvature of about 150 to 200 millimeters.

In accordance with the invention, at the forward contact line, when the flat ski is no longer loaded at its end, but just at its waist, the running surface is separated from the horizontal plane by a height of between 1 and 2 mm. In other words, by defining the forward contact line on each ski, it is possible to measure the height which separates the running surface from the horizontal plane when the ski is set flat, in the measurement conditions of ISO standard 6289, it being understood that the contact lines and end contact points are determined with a 0.1 mm and not a 0.5 mm gage as recommended under said standard.

According to another inventive feature, the front end contact point as defined above, and in respect of a tilt of the ski of 45°, is at a distance of less than 4 cm, or even 3 cm, and preferably 2 cm away from the forward contact line also defined above, to the front or to the rear of said line.

In accordance with another inventive feature, the midpoint, between the front and rear end contact points, moves towards the front of the ski when the angle of tilt thereof increases. In other words, the middle of the contact length, still determined by loading the ski at its waist so as to bring the edge onto the horizontal plane, changes in a specific way. Indeed, the larger the angle of tilt of the ski, the further forward this mid-point of the contact length is. In other words, the more tilted the ski, the further forward the mid-point of the contact length becomes. This point is generally located beyond the shoe mid-point, i.e. the "boarding point" according to the definition in ISO standard 6289. In these conditions, the skier finds himself with a point for the application of his weight that is further and further back from the middle of the contact length, when the ski tilt angle increases, which improves ski control, and gives an increasingly high-performance ski.

BRIEF DESCRIPTION OF THE DRAWINGS

The way of embodying the invention, and the resulting advantages, will become clear from the description of the following embodiment, and then from the appended figures wherein:

FIG. 1 is a side view of a ski in accordance with the invention, shown unloaded;

FIG. 2 is a side view of the ski in FIG. 1, set flat, and shown loaded at its waist;

FIG. 3 is a side view showing the ski in FIG. 1 tilted at 45°, and loaded at its center;

FIG. 4 is a cross-section view along the plane IV-IV in FIG. 3;

Figure 5:
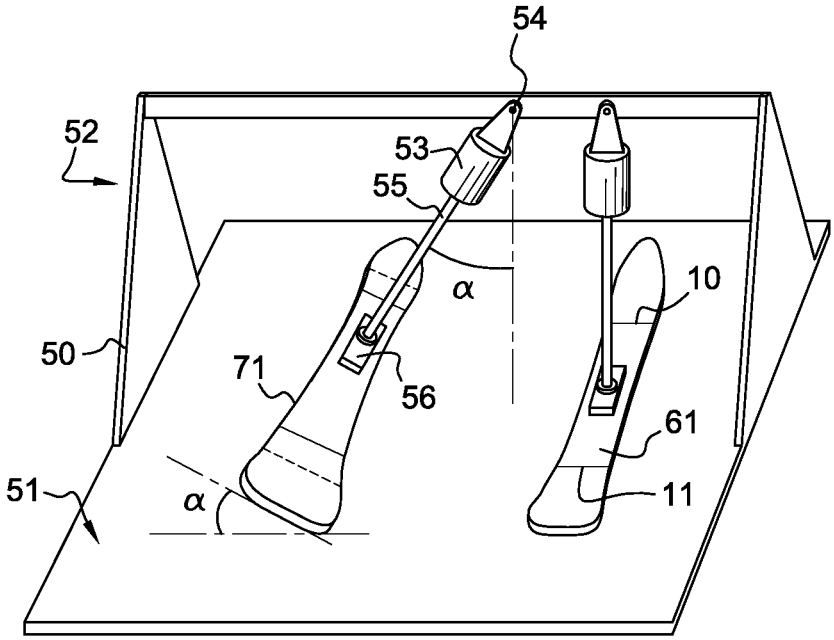
FIG. 5 is an outline perspective view of a facility used to measure the characteristic parameters of two inventive skis.

Clearly, the forms and dimensions shown in the figures are only given by way of example. They may thus differ from reality and are in some cases exaggerated or out of proportion, for the sole purpose of facilitating understanding of the invention.

DETAILED DESCRIPTION OF THE INVENTION

As shown in FIG. 1, a ski 1 rests on a horizontal plane 2 via two contact zones 3, 4 between which the running surface of the board 5 is separated from the horizontal plane 2 by a camber 6.

Conventionally, the ski has a mark 9 embodying the middle of the shoe of the user, denoted in ISO standard 6289 as the "boarding point", and relative to which the safety fastenings will be mounted.

When, as shown in FIG. 2, the ski is loaded at the center so as to cancel the camber 6, the contact zone between the running plate 5 and the plane 2 extends between the front contact line 10 and the rear contact line 11. As an example, the front contact line 10 is located at a distance of about 30 to 40% of the length of the ski, starting from the boarding point 9, and preferentially between 35 and 37%. Forward from the front contact line 10, is therefore determined the tip 12 which can itself be broken down into two adjacent areas, whereof the boundary is not however defined in a standardized way. A first part 13 constitutes the start of the tip and has a large radius of curvature. This first part 13 is extended by a second part 14 constituting the tip upturn which has a smaller radius of curvature and ends with the front end 15 of the board. In accordance with the invention, the ski has a particular "tip profile", i.e. a change in height of the lower surface of the tip relative to the horizontal plane 2.

Between the two contact lines front 10 and rear 11, is defined in a standardized way the waist zone 16. To the rear of the contact line 11, is defined the tail 17 which ends with the rear end 18 of the board. It is possible for the tail 17 also to have a structure similar to that of the tip, with two zones that have markedly different radii of curvature, but this is not mandatory however. Likewise, according to the invention, the tail 17 has a particular "tail profile", i.e. a change in height of the lower surface of the tail relative to the horizontal plane 2. The ski has a side cut that broadens beyond the front 10 and rear 11 contact lines.

Thus, when the ski is flat as shown in FIG. 2, the contact surface which is edged by the contact length has a length $LP_0$ measured longitudinally, and corresponding to the distance between the front contact line 10 and the rear contact line 11.

According to one inventive feature, the contact length changes in a particular way when the ski is tilted laterally. Thus, when the ski is tilted by pivoting it around an axis parallel to its longitudinal axis, it rests on the horizontal plane at two contact zones each located in the tip and the tail. In the most frequent case where the ski has a deep side cut, the edge is not in contact with the horizontal plane in the middle of the waist, so long as the ski is not loaded. However, as shown in FIGS. 3 and 4, when the ski receives a stress perpendicular to its upper face, applied substantially at the shoe mid-point 9, the ski bends, until the edge touches the horizontal plane 2 at the shoe mid-point 9. In this case, as shown in FIG. 3, a gage of 0.1 mm thickness is used to determine the end contact points 23, 24, which represent the front and rear limits of the contact zone between the edge 20 and the horizontal plane 2. It should be noted that depending on the geometry of the ski, it is possible for the edge not to touch the horizontal plane over its entire length between the end contact points 23, 24, without however modifying the definition of these points. The distance $LP_\alpha$ between the two transverse lines 25, 26 passing through the front 24 and rear 23 end contact points, corresponds to the contact length when the ski is tilted at an angle $\alpha$. It should be noted that these two lines 25, 26 are identified when the ski is tilted on the edge, loaded by a stress of at least 40 Newtons applied at the boarding point 9, in a direction perpendicular to the ski, and by means of a 0.1 mm gage. Next, the distance $LP_\alpha$ between these two lines 25, 26 is measured when the ski is flat and loaded at its center. It should be noted that according to the invention, the side cut broadens at least as far as the end contact points 23, 24.

Figure 6:
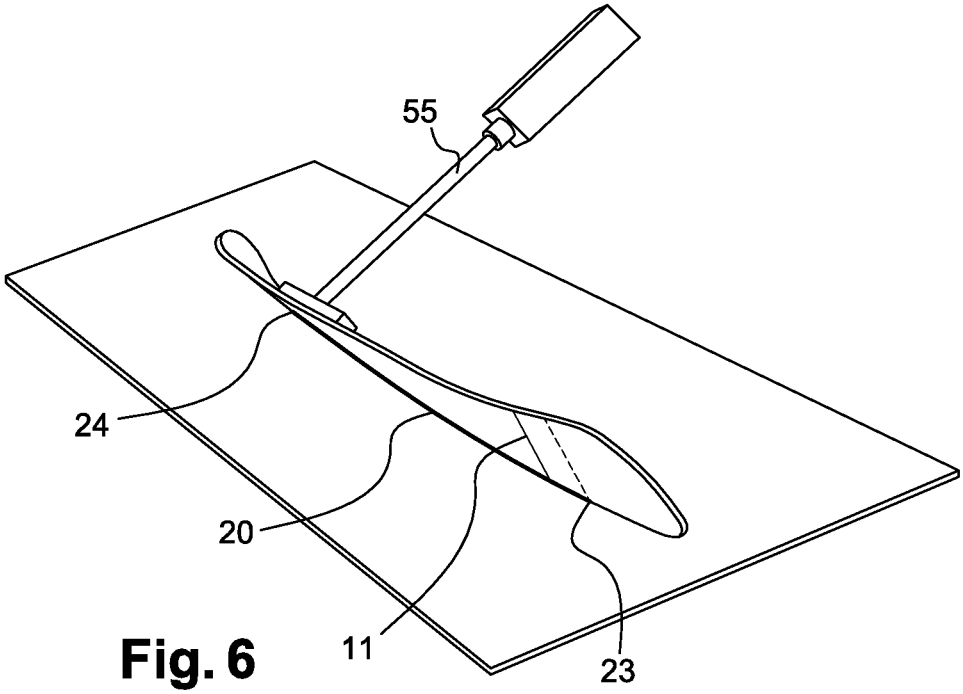
FIG. 6 is an outline perspective view showing one of the skis in FIG. 5 at a three quarter angle underneath.

To be more specific, the procedure for measuring the different characteristic contact lengths is shown in FIGS. 5 and 6. This procedure is used to act upon the skis in a way similar to the behavior of the ski during a turn. It is used also to combine the side cut and tip and tail profile parameters in order to study the change in the contact lines. Said system 50 thus comprises a very rigid non-deformable horizontal table 51, surmounted by a gantry 52 bearing a jack 53 whereof the position of the fastening point 54 may be adjusted as a function of the measurement to be made. The tilt of the jack 53 and particularly of the rod thereof, may thus be modified as a function of the required tilt $\alpha$, said angle $\alpha$ corresponds to the edging angle.

At the end of the jack rod 55 is placed a plate 56 so that a seat is provided on the upper face of the board 1. It is also possible for this plate to be seated in the elements constituting the safety fastenings. This plate 56 thus serves to distribute some of the stresses exerted by the jack on a zone of the waist surrounding the shoe mid-point also ensuring that the stress is exerted perpendicularly to the surface of the ski. Thus, in the configuration shown on the right in FIG. 5, the ski 61 is lying flat, and receives a vertical stress at the waist, which in the configurations in ISO standard 6289, and with a 0.1 mm gage allows the positions of the front 10 and rear 11 contact lines to be defined.

To measure the contact length when the ski 71 is tilted on the edge with an angle α, the fastening point 54 of the jack is positioned in such a way that its rod forms an angle α with a perpendicular to the plane of the table. In a preferential way, the plate located at the end of the jack rod is secured to the board in such a way that adjusting the angle of the jack fixes the tilt of the board relative to the plane with the same angle α.

A stress is then exerted by the jack rod in such a way that, as shown in FIG. 6, the edge 20 of the ski comes into contact with the plane of the table 51. The end contact points 23, 24, are then determined for a given tilt. In accordance with the invention, the ratio of the distance $D_\alpha$ separating the front end contact point 24 from the front contact line 10, related to the distance D separating the front contact line 10 from the same shoe mid-point 9, is more than 12% for a tilt α of 35°, and more than 15%, and to advantage between 18 and 21%, for a tilt α of 45°. Thus, according to the invention, the choice of a side cut that broadens beyond the front contact line, and of a particular tip profile, can be used to increase the contact length between flat ski and ski tilted on the edge.

Figure 7:
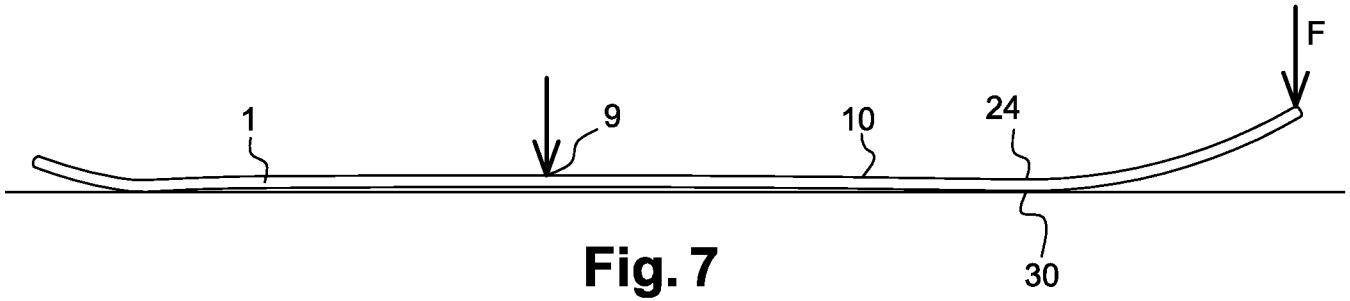
FIG. 7 is a side view of the ski in FIG. 1 shown loaded at its front end.

According to another inventive feature, it is also possible to determine a point that is advantageous in terms of the positioning of the end contact points, particularly in the tip zone. Said point is determined as shown in FIG. 7 when the ski is loaded at its center, in such a way that its camber is canceled, and that it receives complementarily a calibrated stress F at its front end 1.

In practice, this stress is selected to have a value equivalent to 2 kg, in such a way that the contact surface between the running surface and the horizontal plane 2 is lengthened relative to the bearing length when the ski is loaded only at its waist. This limit, known as the "forward contact line", constitutes the point of reference 30 on the ski. The ski side cut broadens from the waist as far as this forward contact line, and beyond this may either broaden further or start to contract in the direction of the end of the ski.

Figure 8:
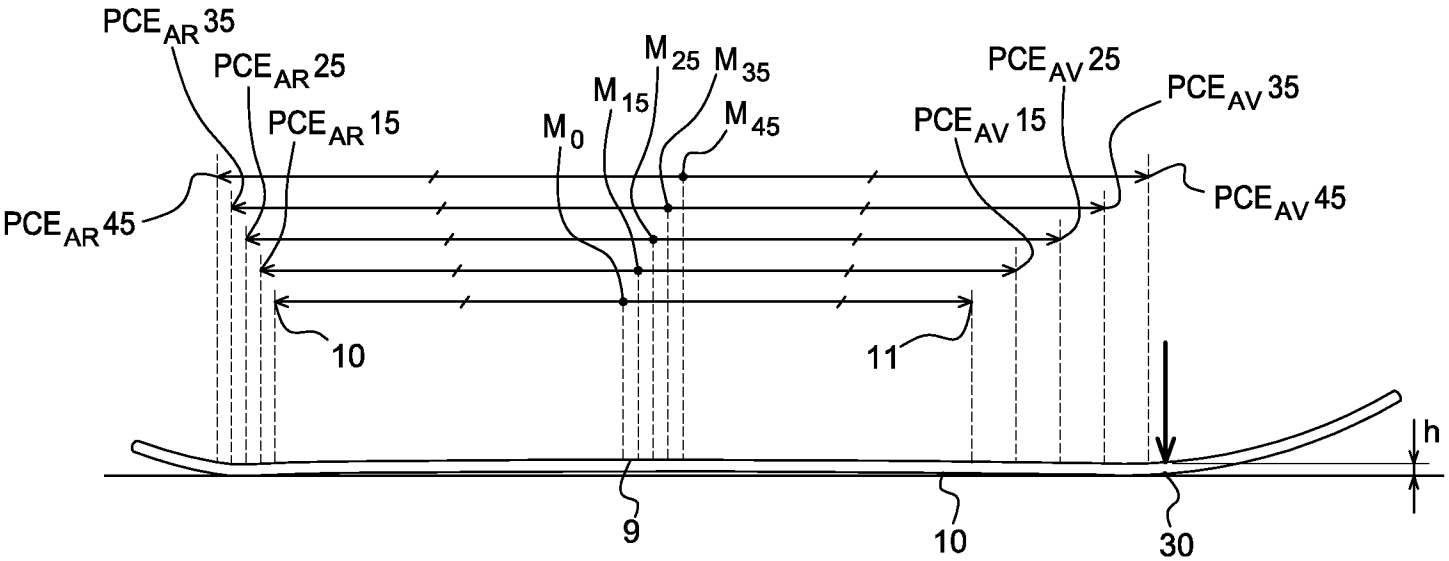
FIG. 8 is a side view of the ski in FIG. 7, shown loaded solely at the waist, wherein some characteristic parameters are shown.

As shown in FIG. 8, when the stress F exerted on the front end is relaxed, the tip resumes its normal configuration, starting with the front contact line 10.

According to another inventive feature, the height h separating the running surface from the horizontal plane 2, when the ski is flat, loaded at the waist, at the forward contact line 30, is between 1 and 2 mm.

It has furthermore been noted in respect of the inventive skis, that for a tilt α of 45°, the front end contact point 24 is close to the forward contact line 30, and is located less than 40 mm, or even 30 mm, and preferably about 20 mm therefrom, forward or rearward.

The parameters of the ski, and particularly the side cut and the tip and tail height parameters, are selected in such a way that the contact length at the tip gradually increases as a function of the edging angle α, up to a maximum value close to the forward contact line 30. At the tail, the rear end contact point position 23 may not be very far away from the rear contact line position 11, or move rearwards when the edging angle α increases. It is advantageous for the movement of the rear end point 23 to increase less quickly than the movement of the front end point 24. At this rear end contact point 23, for a tilt of 45°, the height separating the running surface from the horizontal plane is less than 1 mm, when the ski is flat and loaded at the waist.

According to another inventive feature, it is advantageous to note that the middle of the contact length for different tilts α, changes in a way that promotes turn control. Thus, as shown in FIG. 8, the reference markers $PCE_{AR45}$, $PCE_{AV45}$, $PCE_{AR35}$, $PCE_{AV35}$, $PCE_{AR25}$, $PCE_{AV25}$, $PCE_{AR15}$, $PCE_{AV15}$ of the end contact points have been given at the front and at the rear for different tilts of 45, 35, 25 and 15°, it being understood that for a tilt α of 0°, the end points correspond to the front 10 and rear 11 contact lines. The positioning of the middle of the end contact points for these different tilts corresponds to the points $M_0$, $M_{15}$, $M_{25}$, $M_{35}$, $M_{45}$. It will be noted that these points are positioned in such a way that they get closer to the front of the ski when the angle of tilt α gets bigger. This means that the front end contact point moves further away from the middle of the shoe 9 than the rear end contact point. In some configurations, and particularly for large angles α, this mid-point of the contact length is found forward from the shoe mid-point 9. Said configuration has given good results in terms of behavior and corresponds in particular to a high-performance ski when it is sufficiently tilted on the edge.

A particular example, which is under no circumstances restrictive, offers the following dimensional parameters:

length of ski: 166 cm position of the shoe mid-point 9: 780 mm from the rear end 18 position relative to the shoe mid-point 9, side cut (or width), and height relative to the horizontal plane ski loaded flat at the waist, for a plurality of particular points, according to the table hereinafter

| Particular points | Distance to the shoe mid-point 9 (in mm) | Side cut (in mm) | Height (in mm) |
|---|---|---|---|
| Front contact line 10 | 605 | 98 | 0 |
| Front end contact point at 15° $PCE_{AV15}$ | 632 | 100 | |
| Front end contact point at 25° $PCE_{AV25}$ | 692 | 106 | |
| Front end contact point at 35° $PCE_{AV35}$ | 715 | 108 | |
| Front end contact point at 45° $PCE_{AV45}$ | 725 | 109 | 1 |
| Forward contact point 30 | 730 | 110 | 1.4 |
| Rear contact line 11 | 612 | 99 | 0 |
| Rear end contact point at 35° $PCE_{AR35}$ | 623 | 99.8 | |
| Rear end contact point at 45° $PCE_{AR45}$ | 626 | 100 | 0.3 |

It is clear from what has been said above that the inventive ski has many advantages, particularly in that it combines good maneuverability when the ski is flat with good turn control when the ski is tilted, by means of a relatively longer contact length. This increase in contact length is sufficiently large for the difference between the ski when flat and the ski on the edge at 45° to be significant. Therefore, according to the invention, the skier has a ski of given length, a length he uses optimally starting from an edging angle of 45°, but which is equivalent to a ski of shorter length when flat, by about 15%. By way of example, a ski 166 cm long corresponds when flat to a ski of about 141 cm in size, and a 176 cm ski corresponds when flat to a ski of 153 cm in size. These skis are of particular advantage for use on-piste, and therefore are less than about 85 cm wide at the waist, or even preferably less than 80 mm.

What is claimed is:

1. A ski, having a longitudinal axis, a waist, first and second edges, and a shoe mid-point, comprising:

a contact surface extending between front and rear contact lines when the ski is flat on a horizontal plane and loaded at the waist such that the first and second edges touch said horizontal plane at the waist; and a contact length extending between front end and rear end contact points when the ski pivots about the longitudinal axis at a tilt angle (α) relative to the horizontal plane and is loaded at its waist such that the first edge touches the plane at the waist;

and wherein when the tilt angle (α) is about 35°, the ratio of the distance (Dα) separating the front end contact point and the front contact line to the distance (D) separating the mid-point of the shoe and the front contact line, is more than 12%.

2. The ski as claimed in claim 1, wherein when the tilt angle (α) is about 45°, the ratio (Dα/D) is more than 15%.

3. The ski as claimed in claim 1, wherein when the tilt angle (α) is about 45°, the ratio (Dα/D) is between 18% and 21%.

4. The ski as claimed in claim 1, wherein when the tilt angle (α) is about 35°, the distance (Dα) separating the front end contact point and the front contact line is more than 70 millimeters.

5. The ski as claimed in claim 1, wherein when the tilt angle (α) is about 45°, the distance (Dα) separating the front end contact point and the front contact line is more than 90 millimeters.

6. The ski as claimed in claim 1, wherein the ski has a forward contact line corresponding to the front limit of the contact surface as extended when the ski is flat on a horizontal plane and loaded at the waist and receives a vertical force (F) corresponding to the weight of a mass of 2 kg at its front end, and wherein, the height separating said forward contact line and the horizontal plane is between 1 and 2 mm when the ski is loaded only at the waist.

7. The ski as claimed in claim 6, wherein when the tilt angle (α) is about 45°, the end contact point is at a distance of less than 4 cm away from the forward contact line.

8. The ski as claimed in claim 1, wherein as the tilt angle (α) increases, the midpoint between a front end contact point and a corresponding rear end contact point moves towards the front of the ski.

9. The ski as claimed in claim 1, wherein when the tilt angle (α) is 0°, the height separating the rear end contact point when the tilt angle (α) is about 45° and the horizontal plane is less than 1 mm.

10. The ski as claimed in claim 1, wherein the ski is less than about 85 cm wide at the waist.

11. A ski having a forward contact line corresponding to the front limit of the contact zone of the ski on a horizontal plane when the ski is applied on said horizontal plane at its waist and receives a vertical force (F) corresponding to the weight of a mass of 2 kg at its front end, and wherein when the ski has a tilt angle (α) of about 45° relative to said horizontal plane, a front end contact point is at a distance of less than 4 cm away from the forward contact line.

12. The ski as claimed in claim 7, wherein the front end contact point is at a distance of less than 2 cm away from the forward contact line.

13. The ski as claimed in claim 10, wherein the ski is less than about 80 mm wide at the waist.

14. The ski as claimed in claim 11, wherein the front end contact point is at a distance of less than 2 cm away from the forward contact line.

15. The ski as claimed in claim 1, wherein the front end and rear end contact points extend farther from the front and rear contact lines as the longitudinal tilt angle increases, gradually increasing the ratio of the distance (Dα) separating the front end contact point and the front contact line to the distance (D) separating the shoe mid-point and the front contact line, and gradually increasing the ratio of the distance separating the rear end contact point and the rear contact line to the distance separating the shoe mid-point and the rear contact line.

* * * * *